US008678092B2

(12) United States Patent
Assal et al.

(10) Patent No.: US 8,678,092 B2
(45) Date of Patent: Mar. 25, 2014

(54) CONTROLLABLY INSTALLED MULTILATERAL COMPLETIONS ASSEMBLY

(75) Inventors: Anwar Ahmed Maher Assal, Bougival (FR); Nabil Batita, Gabes (TN)

(73) Assignee: Schlumberger Technology Corporation, Sugar Land, TX (US)

( * ) Notice: Subject to any disclaimer, the term of this patent is extended or adjusted under 35 U.S.C. 154(b) by 184 days.

(21) Appl. No.: 13/195,122

(22) Filed: Aug. 1, 2011

(65) Prior Publication Data

US 2012/0138301 A1 Jun. 7, 2012

Related U.S. Application Data

(60) Provisional application No. 61/370,623, filed on Aug. 4, 2010.

(51) Int. Cl.
*E21B 19/16* (2006.01)

(52) U.S. Cl.
USPC ..... 166/313; 166/50; 166/117.5

(58) Field of Classification Search
USPC ..... 166/313, 50, 117.5, 117.6, 332.4
See application file for complete search history.

(56) References Cited

U.S. PATENT DOCUMENTS

| | | | | |
|---|---|---|---|---|
| 5,730,224 | A * | 3/1998 | Williamson et al. | 166/386 |
| 6,279,659 | B1 * | 8/2001 | Brunet | 166/313 |
| 6,315,054 | B1 * | 11/2001 | Brunet | 166/387 |
| 2002/0000319 | A1 | 1/2002 | Brunet | |
| 2002/0023754 | A1 | 2/2002 | Buytaert | |
| 2002/0029886 | A1 | 3/2002 | Pringle et al. | |
| 2004/0003925 | A1 | 1/2004 | Desai | |

OTHER PUBLICATIONS

PCT/US2011/046079—International Search Report and Written Opinion of the ISA dated Jan. 4, 2012.

* cited by examiner

*Primary Examiner* — William P Neuder
(74) *Attorney, Agent, or Firm* — Brandon S. Clark

(57) ABSTRACT

A multilateral completions assembly having selectively isolated lateral legs during hardware installation. The assembly includes a variety of isolation sleeves disposed interior of the main bore casing and adjacent corresponding pre-located windows through the casing. Thus, lateral legs may be sequentially created through the formation at each window in a manner that allows for follow-on isolation. As a result, fluid losses from newly formed legs may be avoided during completions operations. That is, as each leg is formed it may also be isolated in advance of forming of the next leg thereby enhancing the efficiency of completions operations as well as follow-on production.

20 Claims, 6 Drawing Sheets

CONTROLLABLY INSTALLED MULTILATERAL COMPLETIONS ASSEMBLY

PRIORITY CLAIM/CROSS REFERENCE TO RELATED APPLICATION(S)

This patent Document claims priority under 35 U.S.C. §119 to U.S. Provisional App. Ser. No. 61/370,623, filed on Aug. 4, 2010, and entitled, "Through Completion Sidetrack System", incorporated herein by reference in its entirety.

FIELD

Embodiments described relate to multilateral completions assemblies. In particular, tools and techniques are described that allow for the undertaking of completions operations and hardware installation in a manner that substantially avoids interference from unintended fluid production. Thus, these tools and techniques may be particularly advantageous when employed in conjunction with wells having a variety of uncased, or at least temporarily open, lateral legs emerging from a main bore.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

In terms of architecture, a well often includes a variety of lateral legs emerging from a main bore. For example, the terminal end of a cased well often extends into an open-hole region branching out into multiple lateral legs providing reservoir access. Of course, such open-hole lateral legs are also often found extending from other regions of the main bore as well. This type of architecture may enhance access to the reservoir, for example, where the reservoir is substantially compartmentalized. Regardless, such open-hole lateral leg sections often present their own particular challenges when it comes to completions installation and maintenance.

In many circumstances, the mere creation of the multilateral architecture presents stability issues. That is, once the main bore is formed, and generally cased, the noted variety of lateral legs are sequentially drilled into the formation, emerging from the bore. This results in exposure of the main bore to an emerging open network of legs connected thereto without any fluid or pressure control. This may be of consequence where the nature of the well architecture is such that fluid access is more readily attained, for example, without the need for prior stimulation. That is to say, depending on the nature of the architecture relative the reservoir, the mere process of completing the well and installing hardware may result in fluid losses well in advance of intended production.

In order to avoid such fluid loss interference and allow completions operations to continue, comparatively heavy solid particle fluids may be pumped into the well. Unfortunately, this manner of killing fluid loss or production has significant drawbacks. That is, aside from the operational time lost to the kill application, once installation is completed, follow-on applications dedicated to regaining reservoir access must be undertaken. These applications require more time and resources devoted to the introduction of stimulation and recovery fluids, namely directed at removal of the heavier kill fluids. Overall, the time lost to killing and restoring the well for sake of multilateral completions may be in the neighborhood of days to weeks at a cost of several hundred thousand dollars.

Once more, complete revival of the well following the kill is unlikely. That is, even following well restoration or clean-out applications, the overall efficiency and productivity of the well will remain compromised to a degree as a result of having undertaking the kill application. This is due to the fact that complete removal of the kill fluid is impractical. Indeed, in the multilateral situation, it is quite likely that production from one or more of the multilateral legs will remain closed off even after well restoration. Nevertheless, in the case of multilateral completions prone to fluid losses during installation, operators are left with only the options of utilizing the noted kill techniques or limiting the overall sophistication of the multilateral in terms of depth and number of open legs.

SUMMARY

A multilateral completions assembly is detailed which includes a main bore casing and at least one sidetrack sleeve. The sleeve is positioned at pre-determined locations of the casing and configured for selectively opening and closing. This selective opening may be utilized to create a lateral leg of the well therefrom following by sealing isolation of the leg upon the closing of the sleeve. Additionally, with the sleeve in place during production, selectively opening and closing thereof may be used to govern production at the location of the sleeve.

DETAILED DESCRIPTION

Embodiments are described with reference to certain multilateral completions assemblies. For example, embodiments herein are detailed with reference to a multilateral assembly having a main bore with at least three legs emerging at angled orientations therefrom and into a surrounding formation level. Additionally, these lateral legs of the well are open in nature. However, hardware and techniques detailed herein may be advantageously employed on a host of different well architecture types. For example, the legs may vary widely in number or be subsequently cased. Regardless, embodiments described herein include at least one shiftable isolation sleeve disposed in the main bore adjacent a pre-located window through which a leg into the formation may be formed. Further, the leg may be left controllably uncased or otherwise open relative the formation for at least some period of time without significant concern over fluid losses.

Figure 1:
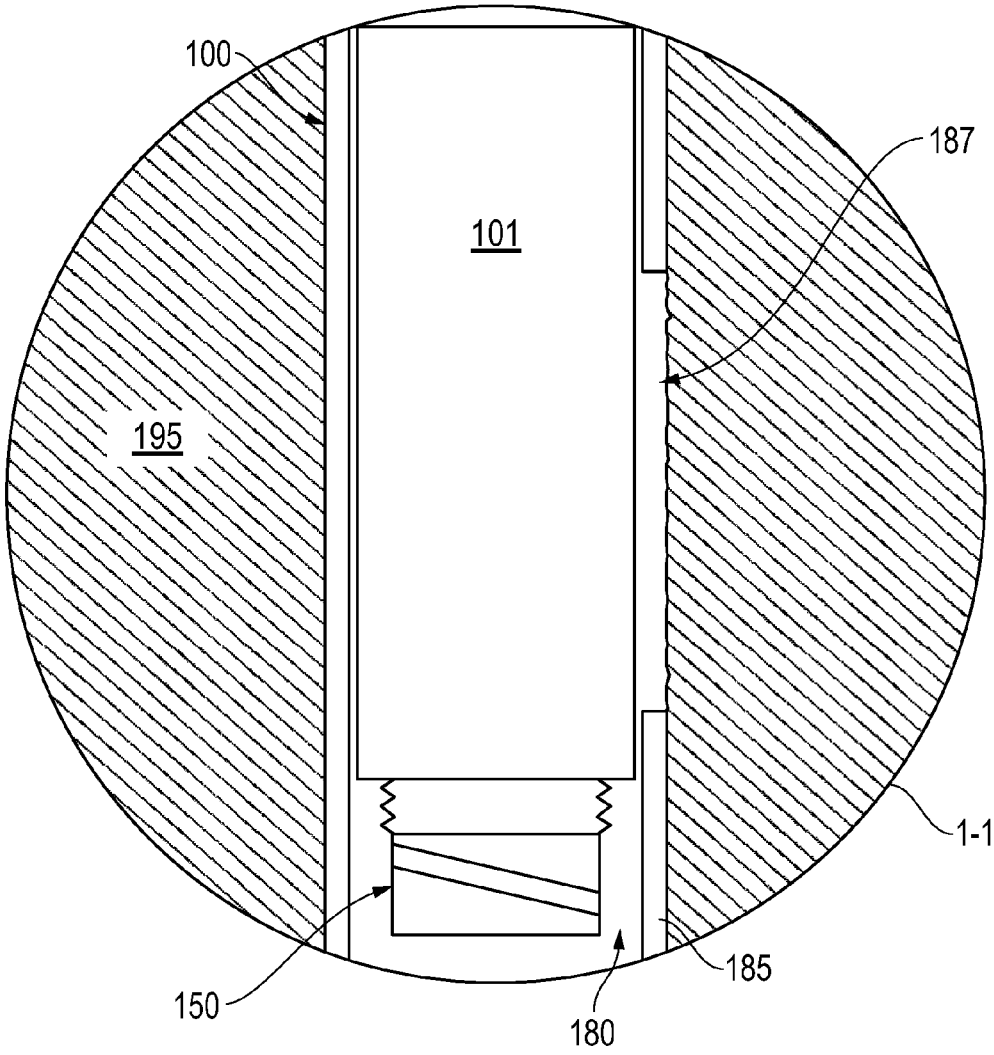
FIG. 1 is an enlarged view of an embodiment of an isolation sleeve of a larger completions assembly taken from 1-1 of FIG. 2.
Figure 2:
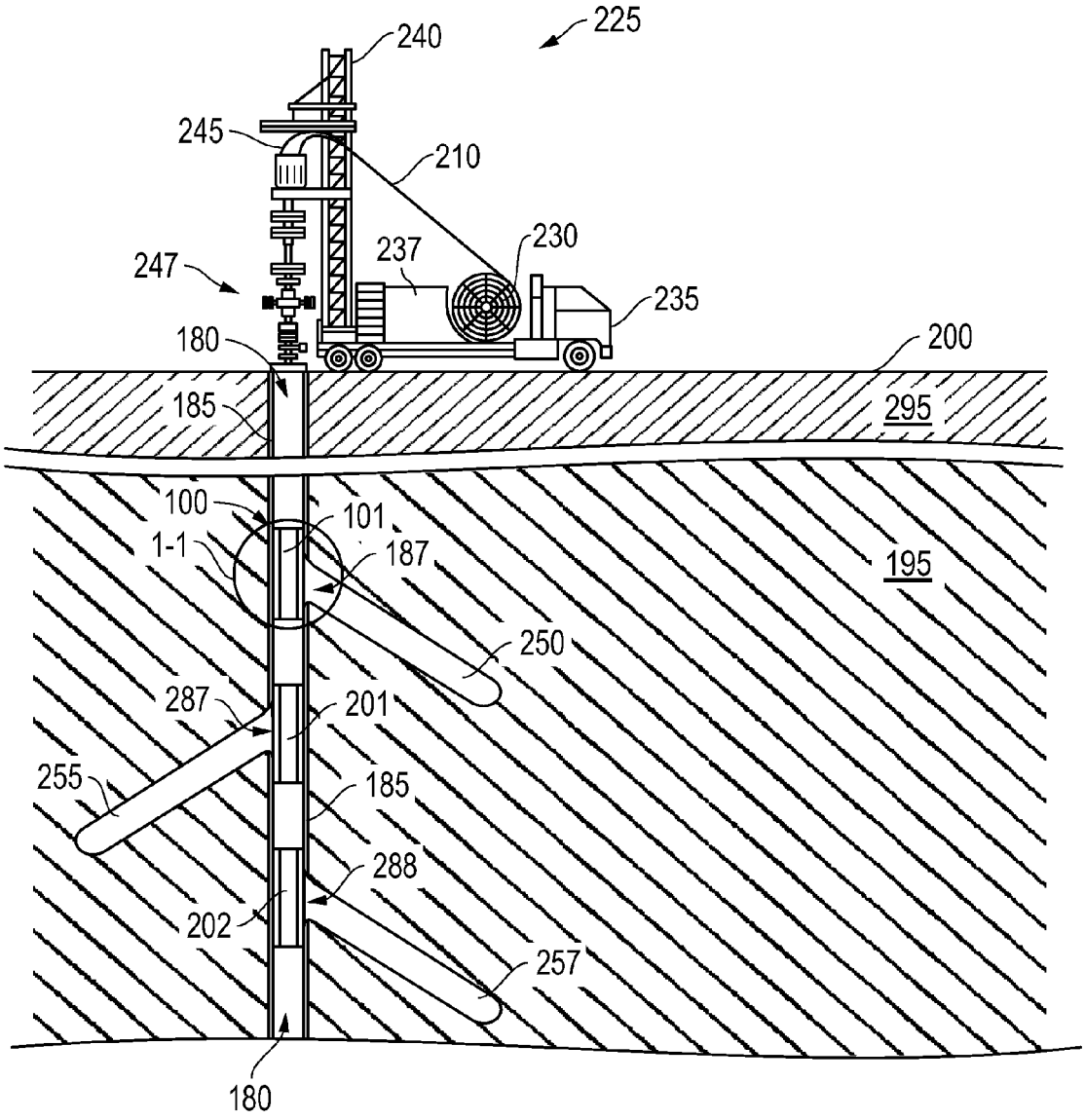
FIG. 2 is an overview of an oilfield with a well of multilateral architecture accommodating the completions assembly with isolation sleeve therein.

Referring now to FIG. 1, an enlarged view of an embodiment of an isolation sleeve 101 is depicted. The sleeve 101, sometimes referred to as a 'sidetrack' sleeve, is part of a larger overall completions assembly 100 for disposal in a well 180 as depicted in FIG. 2. Indeed, the enlarged view of FIG. 1 is taken from 1-1 of FIG. 2 in advance of lateral leg creation. In the enlarged view of FIG. 1, the sleeve 101 is shown adjacent a pre-located window 187 in the casing 185 which defines the well 180. This window 187 is a pre-machined slot which avoids the need for downhole drilling or milling through the casing 185 in order to achieve its creation. Further, it may be alternatingly accessible depending on the location of the sleeve 101. For example, when located as shown in FIG. 1, the sleeve 101 may actually serve an isolating function as detailed further below.

With added reference to FIG. 2, the sleeve 101 may be shifted downhole relative the window 187, for example, to allow window access and creation of a lateral leg 250 into the surrounding formation 195. Further, the sleeve 101 may be returned to an isolating position covering the window 187 as noted above. Once more, the shifting of sleeve position and the forming of the lateral leg 250 may be governed through a landing interface 150 of the sleeve 101. In embodiments described below, this involves the interaction of different portions of a landing 330 of a whipstock tool 300 such as that of FIG. 3A, with the indicated interface 150.

Continuing now with particular reference to FIG. 2, an overview of an oilfield 200 is depicted which includes the above referenced well 180 in a completed state of multilateral architecture. The well 180 traverses various formation levels 195, 295 and accommodates a completions assembly 100 with the described isolation sleeve 101. Indeed, a host of isolation sleeves 101, 201, 202 are incorporated into the assembly 100 and located adjacent corresponding pre-located windows 187, 287, 288. The particular location of the windows 187, 187, 288 may be depend on the estimated location and nature of a formation reservoir. So, for example, in one embodiment, a window-sleeve pairing may be located at every 100-300 meters or so of the casing 185, beginning at a few thousand feet of depth.

In the embodiment shown, even with multiple lateral legs 250, 255, 257 open to the lower formation level 195, the well 180 retains an isolated central borehole, largely unaffected by any potential fluids in these legs 250, 255, 257. So, for example, further multilateral leg creation into the upper formation level 295 may efficiently proceed without any undue concern over interference from fluids draining into the main bore from the depicted legs 250, 255, 257. Along these lines, formation of the depicted legs 250, 255, 257 themselves is likely achieved in a sequential manner, beginning with the lowermost leg 257 and working uphole. Thus, selectively opening and closing sleeves 202, then 201, then 101, to maintain isolation during leg creation may be utilized.

Continuing with reference to FIG. 2, creating the legs 250, 255, 257 upon installation of the assembly 100 may be directed through a variety of sleeve shifting conveyance techniques. For example, in the embodiment shown, coiled tubing surface equipment 225 is utilized. However, wireline, slickline, pipe, tubing, tractoring and other techniques may alternatively be employed.

Where coiled tubing 210 is utilized, a mobile coiled tubing truck 235 with reel 230 may be provided as shown. The truck 235 may also accommodate a control unit 237 for directing a sleeve shifting, water jetting or other downhole application as detailed further below. Additionally, in the embodiment shown, a mobile rig 240 is provided which supports a conventional gooseneck injector 245 and provides alignment over valve and pressure regulating equipment, often referred to as a 'Christmas tree' 247. Through such equipment 225, coiled tubing 210 may be utilized to transform a sleeve outfitted well 180 from a vertical borehole to the more sophisticated multilateral depicted without undue concern over leg fluid interference as noted above.

Figure 3A:
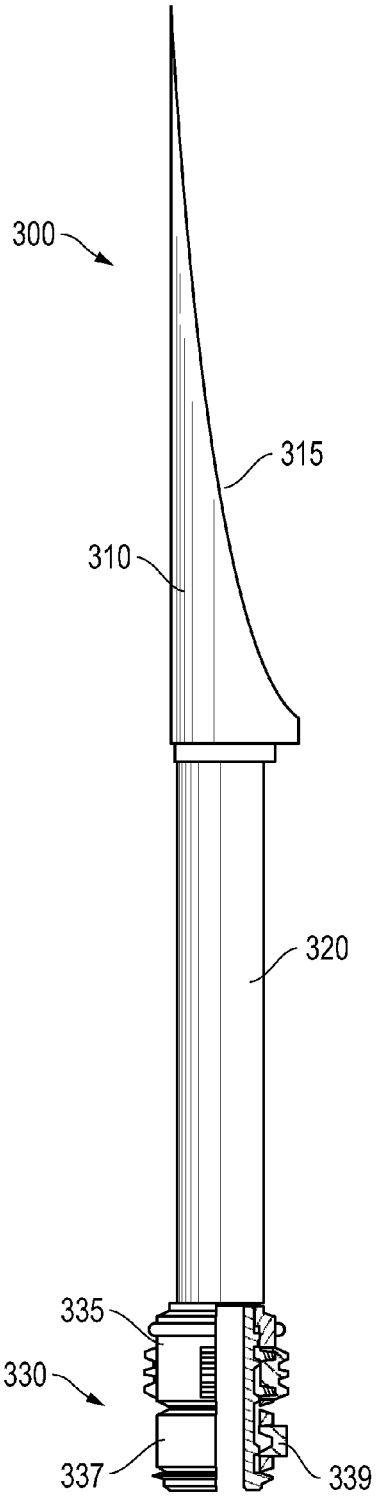
FIG. 3A is a side view of an embodiment of a whipstock tool for shifting the sleeve and guiding multilateral leg creation.
Figure 3B:
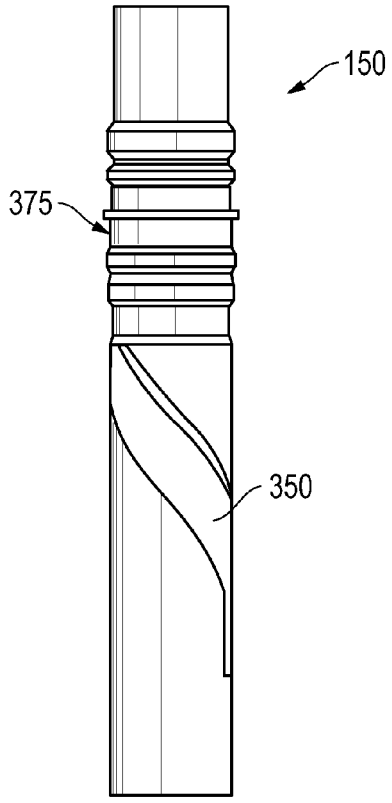
FIG. 3B is a side view of an embodiment of a landing portion of the sleeve for orienting and securing the whipstock tool.

Referring now to FIG. 3A, a side view of an embodiment of a whipstock tool 300 is shown. With added reference to FIG. 2, this tool 300 may be deployed into the well 180 via coiled tubing 210 and to the location of an isolation sleeve 101. More specifically, a conventional running tool 400 may be disposed at the terminal end of the coiled tubing 210 for securing of the deploying whipstock tool 300 (see FIG. 4B). The tool 300 may then be forcibly advanced to engagement with the landing interface 150 of the sleeve 101 as detailed further below (see FIG. 3B). Thus, the sleeve 101 may be shifted open to allow for creation of a lateral leg 250.

Continuing with reference to FIGS. 2 and 3A, the whipstock tool 300 is not only configured for shifting open of the sleeve 101 as noted, it is also configured for subsequent guiding of lateral leg formation. Thus, the whipstock tool 300 is equipped with a head 310 that includes a deflector surface 315 for guiding drilling or other leg forming tools toward the window 187 adjacent the sleeve 101. Along these lines, the landing 330 of the whipstock tool 300 is equipped for both shifting as indicated, as well as orienting of the tool 300 relative the window 187.

The landing 330 is the lowermost portion of the whipstock tool 300 which is displaced from the head 310 by an extension 320. With added reference to FIG. 3B, the landing 330 includes an orienting key 337 with a tab 339 for sliding along a guide track 350 of the landing interface 150 of the sleeve 101. That is, once the landing 330 comes into contact with the interface 150, the tab 339 slides along the track 350 so as to properly orient the tool 300 as further detailed below. At the same time, the tool 300 is also equipped with a shifting key 335 that is of a profile for interlocking with an engagement 375 of the interface 150 (see FIG. 3B). Thus, as the tool 300 is being properly oriented, the shifting key 335 is also coming into an interlocking with the engagement 375. As such, further downhole movement of the tool 300 may lead to shifting downhole of the sleeve 101 as also described further below.

Figure 4A:
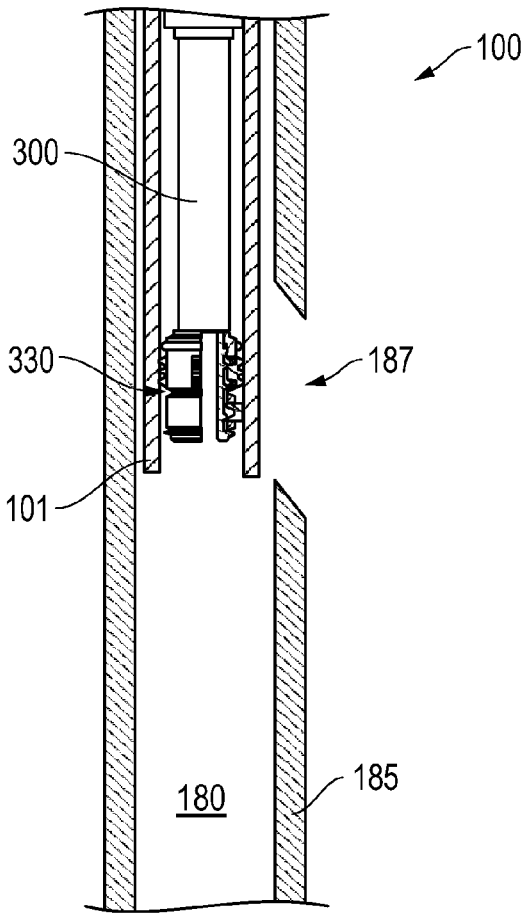
FIG. 4A is a schematic representation of the whipstock tool engaged with the landing portion of the sleeve adjacent a pre-located window of the assembly.
Figure 4B:
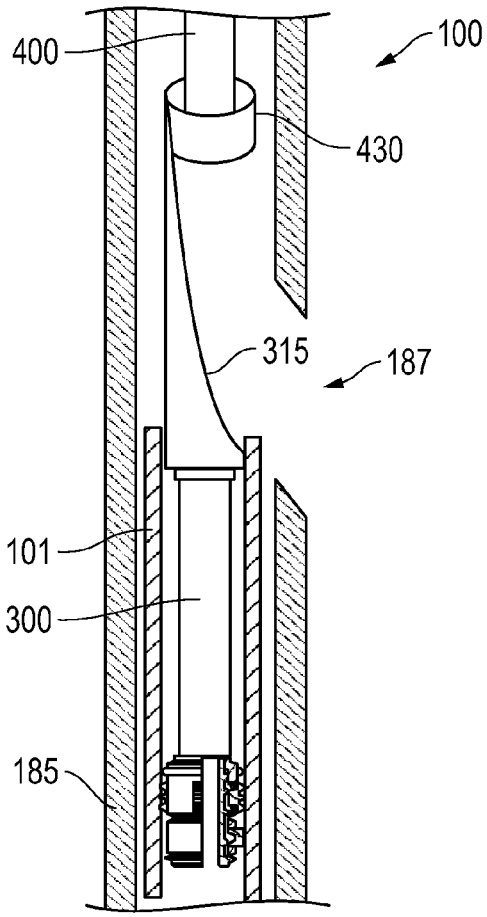
FIG. 4B is a schematic representation of the whipstock tool shifting the sleeve and opening the assembly to the window.

Referring now to schematic views of FIGS. 4A and 4B, the manner and sequence by which the whipstock tool 300 is utilized to shift an isolation sleeve 101 open relative a window 187 is depicted. More specifically, FIG. 4A reveals the landing 330 of the tool 300 as it is received by the sleeve 101 within the casing 185. FIG. 4B depicts continued downhole advancement of the whipstock tool 300 resulting in the noted shifting open of the sleeve 101 relative the window 187.

With particular reference to FIG. 4A, the landing 330 of the whipstock tool 300 is fully interlocked with the sleeve 101. With added reference to FIGS. 3A and 3B, this means that the tab 339 has oriented the tool 300 along the track 350 of the sleeve interface 150. Thus, in a sense, the tool 300 is selforienting. Further, the shifting key 335 of the tool 300 has come into the noted interlocking with the engagement 375 of the interface. That is to say, the selectively matching profile of the key 335 and engagement 375 have come together to achieve the interlocking. This selectivity allows the key 335 to be directed at the noted sleeve 101 without accidentally achieving such interlocking with any other sleeve (e.g. 201 or 202 of FIG. 2).

With the tool 300 and sleeve 101 fully coupled together, a running tool 400 of the coiled tubing 210 may be advanced further downhole to shift open the sleeve 101 as shown in FIG. 4B (also see FIG. 2). In the embodiment shown, the running tool 400 secures a ring 430 of the whipstock tool 300. Regardless, with the sleeve 101 shifted down, the significance of the orientation of the tool 300 relative the window 187 becomes apparent. That is, with the deflector surface 315 adjacently facing the open window 187, follow-on access thereto is made available.

Figure 5A:
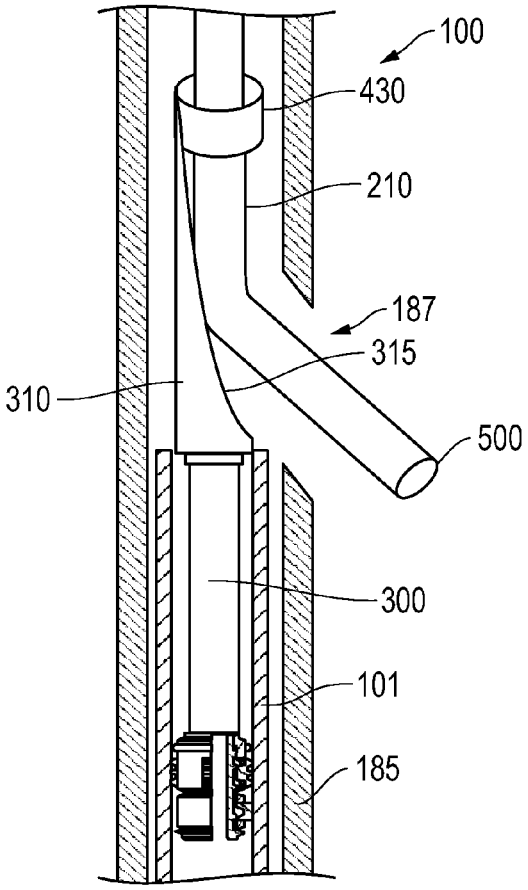
FIG. 5A is a schematic representation of a drilling tool being guided by the whipstock tool through the window to form a lateral leg of the well.

Referring now to the schematic of FIG. 5A, the available access to the window 187 from within the casing 185 allows for a drilling or jetting tool 500 to be run into the well 180 and past the window 187 to form a lateral leg 250 as depicted in FIG. 2. In the embodiment shown, a jetting tool 500 is utilized for leg creation, for example, via conventional acid jetting. However, with the sleeve 101 shifted as shown, a variety of tools may be utilized for a variety of applications which traverse the open window 187. For example, milling or drilling tools may be utilized to form a lateral leg or follow-on logging, stimulation or other interventional tools may be deflected toward the open window 187 as depicted.

Figure 5B:
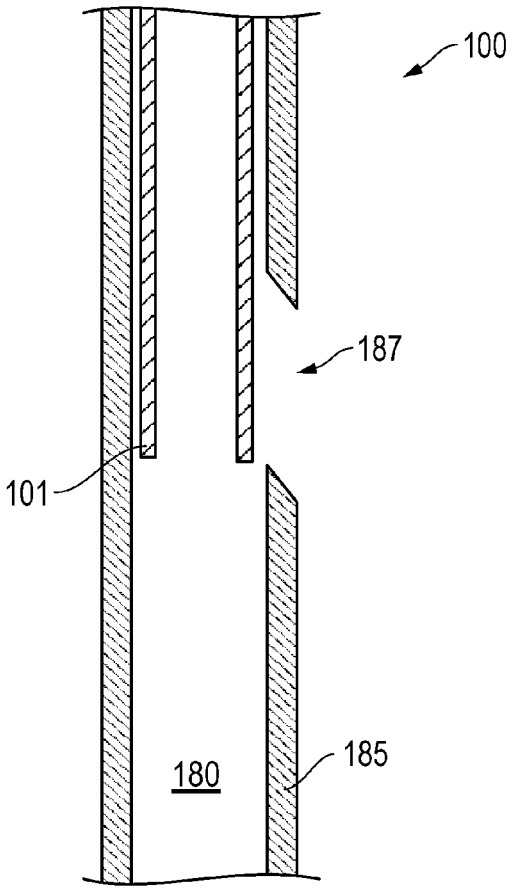
FIG. 5B is a schematic representation of the sleeve closed over the window to isolate the leg from the assembly.

Regardless of the particular application taking place across the open window 187, the sleeve 101 may subsequently be closed as shown in FIG. 5B. Thus, with added reference to FIG. 2, the leg 250 is once again isolated from the main bore of the well 180. In one embodiment, coiled tubing 210 is removed from the well 180 and the jetting tool 500 of FIG. 5A replaced with a retrieving tool similar to the running tool 400 of FIG. 4B. Thus, the ring 430 of FIG. 5A may be secured and the whipstock tool 300 retrieved in a manner that pulls the sleeve 101 back to a closed position over the window 187 as shown in FIG. 5B. Indeed, this manner of opening and closing sleeves 101, 201, 202, particularly for the sake of leg formation as shown in FIG. 2, may be sequentially repeated over and over without substantial risk of fluid losses from exposed lateral legs 250, 255, 257.

Overall, the described manner of achieving such multilateral architecture may provide a more reliable and cost-effective well 180 in terms of both installation and production. Once more, the efficiency of production may be further enhanced due to the availability of pre-located sleeves 101, 201, 201 as depicted in FIG. 2. For example, over the course of the life of the well 180, such sleeves 101, 201, 202 would remain available for selectively closing off unproductive or contaminant producing legs 250, 255, 257. Such is often the case where one or more legs 250, 255, 257 begin to produce water in later years of the life of the well 180.

Figure 6:
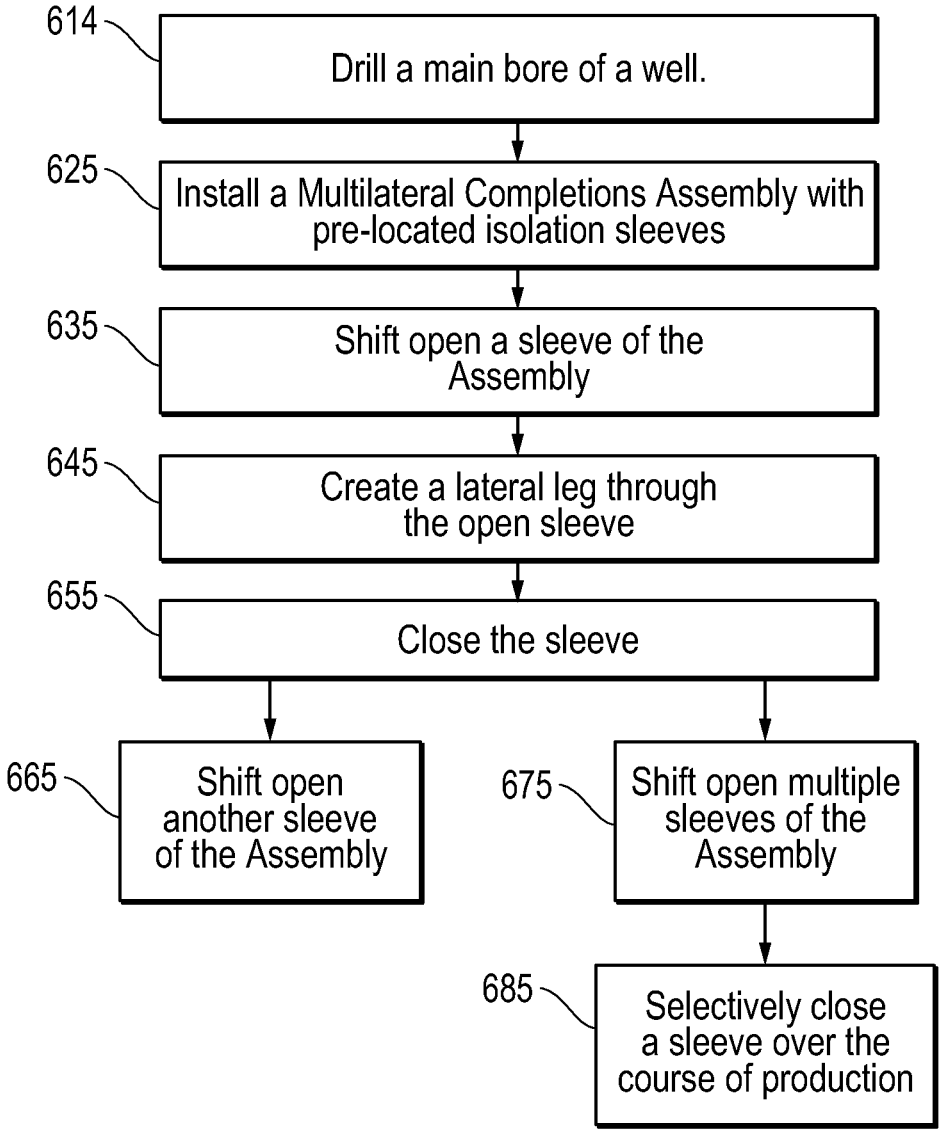
FIG. 6 is a flow-chart summarizing an embodiment of completing and utilizing a controllably installed multilateral completions assembly.

Referring now to FIG. 6, a flow-chart is shown summarizing an embodiment of completing and utilizing a controllably installed multilateral completions assembly. As indicated at 615, a main bore may be formed from which multilateral legs are to be directed at a reservoir. Indeed, a multilateral completions assembly is installed as indicated at 625 which is outfitted with pre-located isolation sleeves. As such, the sleeves may be sequentially opened for one at a time leg formation as noted at 635 and 645. Thus, concern over fluid losses during completions, from lateral legs accessing the reservoir may be minimized. This is because in advance of the sequential forming of a leg, the more recently formed legs may be isolated by closing the sleeve thereof as indicated at 655.

Once more, in addition to controllably isolating legs for completions, the finished assembly remains outfitted with the described sleeves. As a result, production may be initiated with all or most sleeves open as indicated at 675. Nevertheless, over the course of production, circumstances may dictate that one or more sleeves be selectively closed as noted at 685, for example as associated legs begin to produce water, gas or other undesirable contaminants. Thus, the efficiency of production may be enhanced, particularly over later years of the life of the well.

Embodiments described hereinabove include a completions assembly that enhances the efficiency and controllability of installation through use of isolation sleeves at pre-located casing windows. As such, fluid losses during installation, from recently formed legs of a multilateral well, are substantially avoided. This eliminates the need for introduction of solid particle well killing fluids. Thus, substantial time and expenses are saved in terms of killing and reviving the well for sake of hardware installation. Once more, avoiding the introduction of well killing fluids also avoids potentially compromising ultimate production from regions where debris from such fluids is less than fully removed. In total, embodiments of the completions assembly detailed allow for more sophisticated multilateral wells of greater depths without significant concern over fluid losses during installation or corresponding well killing techniques directed thereat.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A method of forming a multilateral completions assembly, the method comprising:

installing a casing with pre-located windows therethrough in a well to define a main bore thereof;

deploying a tool down through the casing;

orienting the tool and engaging the tool with an isolation sleeve during downward movement of the tool; and after engaging the tool via the downward movement, shifting open the isolation sleeve within the casing adjacent one of the windows by continued downward movement of the tool, thus exposing the main bore.

2. The method of claim 1 further comprising creating a lateral leg into a formation adjacent the casing via the exposed window.

3. The method of claim 2 wherein said creating is achieved by one of jetting, drilling and milling.

4. The method of claim 2 wherein deploying comprises deploying a whipstock tool through the casing for coupling with a landing interface of the isolation sleeve.

5. The method of claim 4 wherein said coupling further comprises:

orienting a deflector surface of the whipstock tool relative the exposed window to guide said creating; and interlocking a shifting key of the whipstock tool with an engagement of the sleeve to aid said shifting open.

6. The method of claim 2 further comprising:

closing the isolation sleeve over the exposed window; and shifting open another isolation sleeve within the casing adjacent another one of the windows for exposure to the main bore.

7. The method of claim 6 wherein the lateral leg is a first lateral leg, the method further comprising creating a second lateral leg into the formation via the exposed window of the other sleeve.

8. The method of claim 7 wherein the second lateral leg is uphole of the first lateral leg.

9. The method of claim 2 further comprising:

opening multiple sleeves adjacent multiple windows leading to multiple lateral legs into the formation; and producing fluids from the legs into the main bore.

10. The method of claim 9 further comprising selectively closing one of the multiple sleeves over a corresponding window to a leg based on the production therefrom.

11. A multilateral completions assembly comprising:

a main bore casing for installation in a well; and at least one isolation sleeve at a pre-determined location of said casing, said sleeve having a landing interface with a guide track to orient and interlock with a tool during downward movement of the tool to open said sleeve, said sleeve configured for opening and closing relative to a pre-located window in said casing, the opening for creating a lateral leg therefrom, the closing to sealingly isolate the leg from said main bore casing thereafter.

12. The assembly of claim 11 wherein said sleeve is configured to govern production from the leg via selective opening and closing following the creating.

13. The assembly of claim 11 wherein the window is a pre-machined slot through said main bore casing formed in advance of the installation.

14. The assembly of claim 11 wherein said at least one isolation sleeve comprises a plurality of isolation sleeves in the casing separated by between about 100 meters and about 300 meters.

15. The assembly of claim 11 further comprising the tool in the form of a whipstock tool.

16. The assembly of claim 15 wherein the whipstock tool comprises a deflector surface for guiding a leg forming tool toward the window upon the orienting.

17. The assembly of claim 16 wherein the leg forming tool is one of a jetting tool, a drilling tool and a milling tool.

18. The assembly of claim 17 wherein the jetting tool is a coiled tubing acid jetting tool.

19. An assembly comprising:

a shiftable isolation sleeve at a pre-located window of a casing defining a main bore of a well;

a whipstock tool coupled to said sleeve via linear downward movement of said whipstock tool relative to said sleeve to engage said sleeve for opening the pre-located window with continued downward movement, the whipstock tool being used for selective opening and closing of the window; and an application tool disposed through the bore and guided toward the window by a deflector surface of said whipstock tool.

20. The assembly of claim 19 wherein said application tool is one of a tool for creating a lateral leg, a logging tool for advancement into the leg, and a stimulation tool for advancement into the leg.

* * * * *